US005341746A

United States Patent [19]

Theurer et al.

[11] Patent Number: 5,341,746

[45] Date of Patent: Aug. 30, 1994

[54] TRANSPORT WAGON COMPRISING A WAGON FRAME SUPPORTED ON ON-TRACK UNDERCARRIAGES

[75] Inventors: Josef Theurer, Vienna; Manfred Brunninger, Altenberg, both of Austria

[73] Assignee: Franz Plasser Bahn Baumaschinen-Industriegeesellschaft m.b.H., Vienna, Austria

[21] Appl. No.: 19,225

[22] Filed: Feb. 18, 1993

[30] Foreign Application Priority Data

Mar. 16, 1992 [AT] Austria ..... A 530/92

[51] Int. Cl.[5] ..... B65G 67/00

[52] U.S. Cl. ..... 105/355; 104/2; 414/528; 414/518; 414/339

[58] Field of Search ..... 104/2, 7.3; 105/355; 171/16, 130, 138; 37/104, 107; 198/303, 301, 590; 414/528, 518, 519, 339

[56] References Cited

U.S. PATENT DOCUMENTS

| | | | |
|---|---|---|---|
| 2,791,410 | 5/1957 | Allemann | 171/16 |
| 3,319,770 | 5/1967 | Biedess | 198/590 |
| 4,094,249 | 6/1978 | Theurer et al. | 37/104 |
| 4,267,777 | 5/1981 | Theurer et al. | 171/16 |
| 4,355,687 | 10/1982 | Theurer et al. | 104/7.3 |
| 4,430,944 | 2/1984 | Theurer | 171/16 |
| 4,450,771 | 5/1984 | Theurer et al. | 171/16 |
| 4,479,439 | 10/1984 | Theurer et al. | 171/16 |
| 4,799,430 | 1/1989 | Theurer | 104/2 |
| 4,923,355 | 5/1990 | Manani | 104/2 |
| 4,967,845 | 11/1990 | Whitaker, Jr. | 104/2 |

FOREIGN PATENT DOCUMENTS

| | | | |
|---|---|---|---|
| 285668 | 3/1970 | Austria . | |
| 0303037 | 2/1989 | European Pat. Off. | 198/303 |
| 0368046 | 10/1989 | European Pat. Off. . | |
| 8813856 | 2/1989 | Fed. Rep. of Germany . | |
| 9203617 | 3/1992 | PCT Int'l Appl. . | |
| 2194982 | 3/1988 | United Kingdom | 104/2 |

*Primary Examiner*—Mark T. Le

*Attorney, Agent, or Firm*—Meltzer, Lippe, Goldstein, Wolf, Schlissel & Sazer

[57] ABSTRACT

A transport wagon (1) is provided with a wagon frame (4) supported on on-track undercarriages (2) and a conveyor belt (8) extending in the longitudinal direction of the wagon and arranged so as to be inclined relative to the track plane, forming a lower-lying receiving end (11) and an elevated discharge end (12), with which side walls (13) are associated, extending in the longitudinal direction of the conveyor belt, to delimit laterally and form a storage space (14). The wagon frame (4) is formed from a number of frame parts (5) disposed one behind another in the longitudinal direction of the wagon, joined together in an articulated manner in each case in the region of an on-track undercarriage (2), forming an articulation point (6), and having respective individual conveyor belts (8).

11 Claims, 2 Drawing Sheets

TRANSPORT WAGON COMPRISING A WAGON FRAME SUPPORTED ON ON-TRACK UNDERCARRIAGES

BACKGROUND OF THE INVENTION

The invention relates to a transport wagon comprising a wagon frame supported on on-track undercarriages and a conveyor belt extending in the longitudinal direction of the wagon and arranged so as to be inclined in relation to the track plane, forming a lower-lying receiving end and an elevated discharge end, with which side walls are associated, extending in the longitudinal direction of the conveyor belt, to delimit laterally and form a storage space.

A transport wagon of this kind is already known through EP 0 368 046 A2. The elevated and, in the conveying direction, front end- or discharge region of the conveyor belt is designed to project over the end of the wagon frame so that the discharge end of the conveyor belt is positioned above a rear end- or receiving region of a further transport wagon. Thus, with any number of transport wagons joined together to create a train formation, bulk material can be transported continuously, with unloading and loading in each case taking place automatically. In order to create an appropriate bulk material height for the maximum storage of bulk material, the height difference of the conveyor belt between the receiving end and the discharge end is substantially equal to the inside wall height of the side walls. With a known transport wagon of this kind, however, problems occur in track curves relating to the orderly transfer of material from the elevated discharge end onto the preceding lower-lying receiving end, since as a result of the projecting arrangement, the elevated discharge end is moved away from the center of the track to a fairly considerable extent.

Further, a transport wagon comprising a conveyor belt at the base and two side walls extending parallel to one another and forming a storage space is known through DE 88 13 856 U1. The base conveyor belt which extends the whole length of the wagon has, in the transporting direction, a rear or lower-lying receiving end and an elevated discharge end projecting over the front end of the wagon. Two control flaps, each connected to a side wall, are provided in this region. These are designed to pivot about an approximately vertical axis and are in each case connected to an individual pivot drive. In operational use, these flaps essentially fit loosely against the side walls of a preceding further transport wagon and thereby prevent material from escaping laterally. In superelevated curves in which the stored bulk material is pressed towards the lower-lying side wall of the transport wagon, the flap on the inside of the curve can be adjusted by means of a control device in a pivoted position directed towards the wagon center of the preceding transport wagon. This is intended to force the flow of material back towards the center of the wagon for a more satisfactory transfer of material to the preceding wagon. What it primarily achieves, however, is merely an accumulation of material in the region of the discharge end and the side wall with the inwardly pivoted flap.

The object of the present invention consists in the creation of a transport wagon of the type described in the introduction with which, with a reduction in the constructional expenditure, it is possible to transfer material without difficulty onto a further conveyor belt disposed in front in the transporting direction, even in track curves with lateral tilt.

SUMMARY OF THE INVENTION

This object is achieved according to the invention with a transport wagon of the type described in the introduction in that the wagon frame is formed from a number of frame parts, disposed one behind the other in the longitudinal direction of the wagon, joined together in an articulated manner in each case in the region of an on-track undercarriage, forming an articulation point, and having respective individual conveyor belts.

An articulated construction of the wagon frame of this kind enables the transport wagon to be of any length with a correspondingly high storage capacity, it also being possible to dispense with a number of on-track undercarriages as a result of jointly supporting two frame parts on one on-track undercarriage respectively. Arranging an on-track undercarriage at each articulation point and associating an individual conveyor belt respectively with each frame part ensures that, even in track curves, material is transferred in a completely problem-free manner from the rear onto the front conveyor belt, in the operating direction. Thus as a result of the features according to the invention, a transport wagon is created which is considerably more simplified in construction in comparison with the known storage wagons, combined with the unlimited advantages of a conveyor belt arranged in the base region.

A further development of the transport wagon ensures that, with a particularly simple constructional design, even in track curves, material may be freely and evenly transferred from the elevated discharge end of each conveyor belt onto the receiving end of the preceding conveyor belt which lies beneath it.

A trough-like design of the storage container ensures that in the rear end region of the side walls there is sufficient freedom of movement for the discharge end of the rear conveyor belt, so that in track curves the conveyor belts can be freely displaced. In addition, the inclined arrangement of the side walls enables the storage capacity to be increased.

A further advantageous construction serves to delimit the storage container so as to prevent the loaded bulk material in the end region of the conveyor belt from running out particularly during transfer journeys.

Another variant of the invention ensures that even when there is a very large number of interconnected frame parts or conveyor belts, all the conveyor belt drives and other drives present are reliably and adequately supplied with power.

A further development enables the two frame parts, joined together by the articulation point, to be freely displaced in track curves, and enables the individual conveyor belts to have varying rotational speeds.

A specific arrangement of the flaps enables material to be transferred without difficulty, particularly in track sections with superelevation, it being possible, by means of appropriate swivelling or adjustment of the lower flap region of the internally-lying flap towards the center of the conveyor belt, to divert the bulk material transported on and discharged onto the edge of the conveyor belt, before it lands on the conveyor belt lying beneath it, towards the center thereof. In this way the concentration of the discharged bulk material in the lower-lying edge region—created by the lateral tilt—of the preceding conveyor belt is reliably ruled out. Optimum adaptation to different superelevations can be achieved by varying degrees of inclination of the flap. A further particular advantage over the known solution may also be seen in the fact that the bulk material is diverted by means of the flap only after discharge from the discharge position, thereby avoiding an accumulation of material in the region of the flap which would load the conveyor belt as well as the drive thereof.

An arrangement of a lateral tilt measuring device for automatic control ensures precise control of the flaps in dependence on the lateral tilt, entirely independently of incorrect assessments or negligence on the part of the operating personnel, with the result that the bulk material can be transported in track curves in as problem-free a manner as in straight sections.

By means of an upwardly extended construction of the control flaps, the side walls can also be extended at the same time as a control flap, to move the fall line of the bulk material towards the center of the conveyor belt. This construction is particularly suitable for greater heights of stored bulk material.

The invention also relates to an installation, formed by transport wagons according to the invention, for transporting and unloading bulk material, comprising transport wagons disposed one behind the other in the longitudinal direction of the wagons, each having a conveyor belt and being coupled together to create a train formation. The advantage of an installation designed in this way lies in the fact that, depending on the application requirements, a varying number of transport wagons can be put together to form a combined installation. In addition, after it has been emptied, the rear transport wagon in the transporting direction, for example, can be uncoupled without difficulty at the worksite and can be removed for filling, while in the meantime the front transport wagons can be freely emptied at the worksite. The power to the various drives located on the individual transport wagons alternatively may also be supplied by a central power plant located on the drive wagon.

BRIEF DESCRIPTION OF THE DRAWINGS

The invention is described in detail below with the aid of embodiments represented in the drawings, in which.

DETAILED DESCRIPTION OF THE INVENTION

Figures 1, 5:
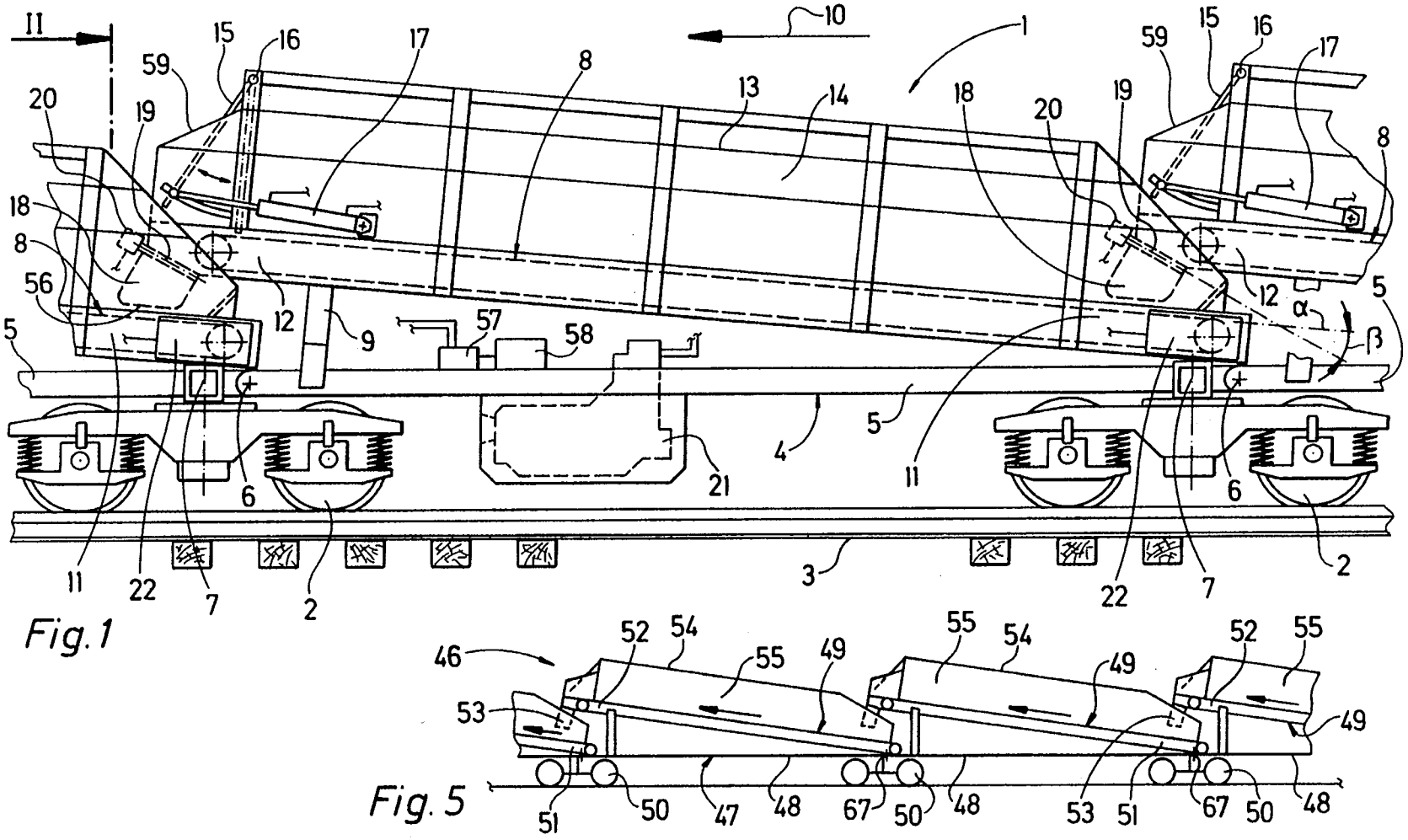
FIG. 1 shows a partial side view of a transport wagon according to the invention, in the region of a frame part.
FIG. 5 shows a partial side view in greatly schematic form of a further form of construction of a transport wagon according to the invention.
Figures 2, 3, 4:
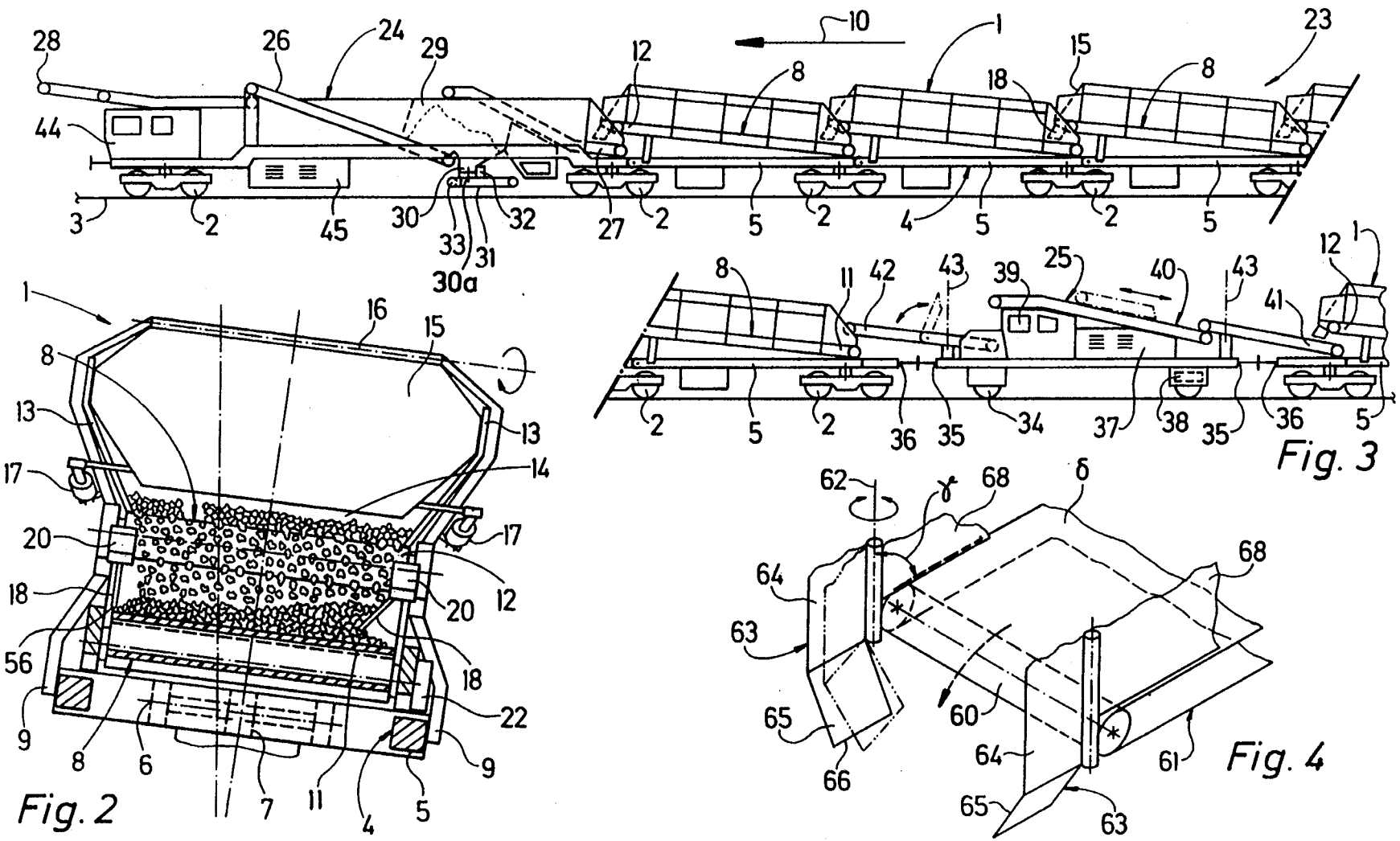
FIG. 2 shows a section or a view of the transport wagon located in a track section with lateral tilt in the longitudinal direction of the wagon, according to arrow II in FIG. 1.
FIG. 3 shows a side view, reduced in scale, of an installation formed with the transport wagon according to FIG. 1, for transporting and unloading bulk material.
FIG. 4 shows a schematically simplified oblique view of the control flaps in a different constructional variant.

Evident in FIG. 1 and 2 is a transport wagon 1 which has a wagon frame 4 movable by way of on-track undercarriages 2 on a track 3. The said wagon frame consists of a number of identical frame parts 5—arranged one behind the other in the longitudinal direction of the wagon—which are joined together at respective articulation points 6 so as to enable the frame parts 5 to be mutually mobile in a universally articulated manner. The articulation points 6 are located immediately in the region of respective bogie pivots 7 of the on-track undercarriages 2 which are designed as bogies.

Each frame part 5 is provided with an individual conveyor belt 8 which extends in the longitudinal direction of the wagon over the entire length of the frame part and which is connected thereto by way of supports 9. An arrow 10 indicates the transporting direction of the conveyor belts 8, these being disposed so as to be inclined relative to the track plane or ascending upwards in the transporting direction. As a result a rear receiving end 11 of each conveyor belt 8 is situated at a lower level than a discharge end 12 preceding it in the transporting direction. The respective ends 11, 12 of the conveyor belts 8 of two interconnected frame parts 5 overlap one another in each case in the region of the bogie pivot 7 of an on-track undercarriage 2.

Located on the two longitudinal sides of each conveyor belt 8 are side walls 13 which extend in the longitudinal direction of the conveyor belt and form an upwardly open storage space 14, at least the lower sections of the side walls 13 being disposed so as to be inclined such that their distance apart increases from the bottom upwards (see FIG. 2). The rear end region of the side walls 13 extends in each case as far as the discharge end 12 of the following conveyor belt 8. In the front end region of each frame part 5, the storage space 14 is delimited by a front wall 15 which is pivotable about a horizontal axis 16 arranged at its upper end and extending in the transverse direction of the wagon. Pivot drives 17, connected to each side wall 13 in an articulated manner, are provided for this purpose and are joined to the front wall 15.

Arranged between a region immediately preceding the discharge end 12 of each conveyor belt 8 and the lower-lying receiving end 11 of the conveyor belt 8 of the frame part 5 which precedes it in the transporting direction are two control flaps 18 which are connected to a pivot drive 20 and which are pivotable by means of the said pivot drive about a pivot axis 19 extending approximately in the longitudinal direction of the wagon. The control flaps 18 are respectively secured in the region of the side walls 13 or on the lower end of a section 59 of the side walls 13 projecting over the front end of the conveyor belt 8. In the unpivoted position, in which the control flaps 18 extend approximately parallel to the vertical, a lower edge 56 of the flaps is positioned immediately above the preceding conveyor belt 8 and is aligned in the longitudinal direction of the conveyor belt. The pivot axis 19 of each control flap 18 is arranged so as to be inclined in relation to the plane, denoted $\alpha$, of the conveyor belt 8, wherein the angle $\beta$ formed between them may be between 0° and about 50°, and in the present embodiment it is about 25°. The two pivot drives 20 are connected to respective control devices 57 and lateral tilt measuring devices 58 located on each frame part 5, as a result of which the pivoting of the control flaps 18 may proceed automatically—in dependence on the superelevation or lateral tilt occurring in track curves—without the need for an operator to intervene. In FIG. 2, which represents such an inclined position, the right-hand, lower- or internally-lying control flap 18 may be seen in the pivoted position. A power unit 21 arranged on each frame part 5 between the on-track undercarriages 2 serves to operate the drives 17 and 20 and a conveyor drive 22 arranged at the receiving end 11 of the associated conveyor belt 8. Each conveyor drive 22 is thus controllable separately independently of the conveyor drives 22 disposed on the other frame parts 5 for different belt speeds.

Represented in FIG. 3 (in two parts for reasons of space) is an installation 23 for transporting and unloading bulk material, in which a transport wagon 1 corresponding to FIGS. 1 and 2 and having a conveyor belt 8 is joined to a discharge wagon 24 preceding it in the transporting direction and—via a following drive wagon 25—to a second transport wagon 1, to create a train formation. The discharge wagon 24 is movable on two on-track undercarriages 2, the rear on-track undercarriage simultaneously forming the front on-track undercarriage, in the transporting direction, of the front frame part 5 of the transport wagon 1. Further, there is provided on the discharge wagon 24 a conveyor belt arrangement 26 extending in the longitudinal direction of the wagon, the receiving end 27 of which, located in the rear region, is associated with the front discharge end 12 of the transport wagon 1. Provided between the receiving end 27 and a discharge end 28 of the conveyor belt arrangement 26, disposed at the front end of the discharge wagon 24, is a ballast store 29 with outlet openings 30. Associated with each of these outlet openings 30 is a discharge conveyor belt 31 which is pivotable about a vertical axis 30*a* and which is equipped with an individual pivot drive 32 and conveyor belt drive 33.

The drive wagon 25 coupled between the two transport wagons 1 is movable on on-track undercarriages 34 and has coupling devices 35 at each end. Associated with these are coupling devices 36 connected to the on-track undercarriages 2 or frame parts 5 at the ends of the two transport wagons 1. Further, the drive wagon 25 is provided with a central power plant 37, a motive drive 38, a driver's cab 39 and a conveyor belt arrangement 40 with a lower-lying receiving end 41 and an elevated discharge end 42. These two ends 41, 42 are arranged so that in the use position they respectively overlap and extend under the associated ends 11, 12 of the transport wagons 1 and are pivotable about vertical axes 43 far enough to ensure that problem-free transfer of the bulk material from or onto the coupled transport wagon 1 is still guaranteed even in tight curves in the track. Furthermore, the ends of the sections of the conveyor belt arrangement 40 projecting over the coupling devices 35 can be folded away or retracted in the known manner for the transfer journey (see the position shown in dot and dash lines).

Before the installation 23 is used operationally, the transport wagons 1 are filled from above with bulk material and are moved to the site of use at which, for example, all the track bedding of the track 3 has been excavated by a preceding excavating machine—which is not represented. New bedding material is now introduced into the track with the installation 23. All the conveyor belts 8 and conveyor belt arrangements 26, 40 here form a continuous conveyor belt route for the further transportation of the stored bulk material or bedding material in the direction of the arrow 10 for delivery at the front discharge end 28 to the excavating machine. The front walls 15 which have been in the lowered or closed position during the transfer journey are now pivoted forwards (FIG. 1) by means of the pivot drives 17 to form an outlet opening for the bulk material. If the installation 23 is positioned in a track curve, the control flaps 18 are controlled automatically such that the bulk material discharged in the lower-lying end region of the conveyor belt 8 is diverted towards the center of the conveyor belt. This ensures that the bulk material landing on the preceding receiving end 11 is not concentrated in the transition region to the lower-lying side wall 13 (this concentration would increase with each further delivery).

In addition to the bedding material delivered at the discharge end 28 and introduced into the track 3 in front of the installation 23, bedding material is also discharged via the outlet openings 30 or the pivotable discharge conveyor belts 31 thereof, should the track not be sufficiently filled in one or other region. In this case by means of the drives 32 and 33 the quantity discharged can be delivered in precisely measured amounts and be directed to the location at which the deficiency has been determined.

The rear transport wagon 1, in the transporting direction, empties first, starting from the rearmost conveyor belt 8. As soon as the whole rear transport wagon is fully unloaded, it may be uncoupled from the installation 23 along with the drive wagon 25 and moved to a different site for reloading without the operational use of the front transport wagon 1 or of the discharge wagon 24 being thereby affected. The said discharge wagon is also provided with a driver's cab 44 and a motive drive 45, so that the mobility of the front transport wagon 1 remains ensured.

A discharge end 60 of a conveyor belt 61 is shown in FIG. 4 in schematic form, this being provided with control flaps 63 which are rotatable about a pivot axis 62. The pivot axis 62 is disposed such that it forms an angle $\gamma$ of about 90° with a plane, denoted $\delta$, of the conveyor belt 61. Each control flap 63 consists of an upper part 64, forming an extension of the respective side wall 68, and a lower part 65 joined to the upper part 64. The lower part 65 of the control flaps 63 has a lower edge 66 which is deflected in the transverse direction of the wagon towards the center of the conveyor belt 61 relative to the plane formed by the upper part 64, as a result of which the lower part 65 of the control flaps 63 already serves in the unpivoted position as a deflector element for diverting or directing the flow of bulk material. A pivoted position of one of the control flaps 63 which is employed in track curves is indicated by double dot and dash lines. It would also be conceivable to design the lower part 65 so that it is adjustable or pivotable in relation to the upper part 64, so that the deflector element can thus find optimum use in various angular positions for different conditions of use as appropriate.

The variant, represented in FIG. 5, of a transport wagon 46 has a wagon frame 47 which is divided into frame parts 48, each having a conveyor belt 49 and being movable on on-track undercarriages 50. The individual frame parts 48 are respectively joined together in the region of an on-track undercarriage 50 at an articulation point 67. Like the form of construction according to FIGS. 1 to 4, receiving ends 51 and discharge ends 52 of successive conveyor belts 49 are also arranged in this case one above the other in the region of one of the on-track undercarriages 50 and are provided with automatically pivotable control flaps 53. In this case, however—in accordance with the height of the side walls 54—the vertical distance apart of the mutually overlapping ends 51, 52 is made large enough to enable the storage spaces 55 of the frame parts 48 also to be filled by means of the conveyor belts 49 instead of using the conveyor belts merely for transporting the bulk material through. In this way the necessity of filling the individual storage spaces 55 of the transport wagon 46 separately from above is dispensed with.

While the invention has been described by reference to specific embodiments, this was for purposes of illustration only. Numerous alternative embodiments will be apparent to those skilled in the art and are considered to be within the scope of the invention.

We claim:

1. A transport wagon comprising a wagon frame supported on-track undercarriages, said wagon frame comprising a plurality of frame parts, each of said frame parts including an individual conveyor belt extending in a longitudinal direction of said wagon, said conveyor belt being inclined relative to a track plane and having a lower-lying receiving end and an elevated discharge end, and sidewalls associated with each conveyor belt, said sidewalls extending in a longitudinal direction of said conveyor belt and delimiting laterally each of said frame parts to form a storage space, each of said frame parts further including control flaps in a region of the sidewalls and the discharge end of each frame part so as to be pivotable about pivot axes and connected to a pivot drive, wherein said control flaps are located between a region of the conveyor belt immediately preceding the discharge end and the receiving end of a preceding conveyor belt in a transport direction, said frame parts being disposed one behind another in the longitudinal direction of said wagon, and being joined together in an articulated manner at articulation points located above said on-track undercarriages, wherein successive frame parts are supported on a common on-track undercarriage, wherein each of said control flaps include a lower edge which is immediately above the conveyor belt of a preceeding frame part when said control flaps are arranged vertically, and wherein an angle formed between a pivot axis of each of the control flaps and a plane of the conveyer belt is between 0° and 50°.

2. The transport wagon of claim 1 wherein said side walls are inclined so that the distance apart of said side walls increases from their associated conveyor belt upwards.

3. The transport wagon of claim 1 wherein each said frame part has an individual power unit and an individual conveyor drive operable thereby for each said conveyor belt.

4. The transport wagon of claim 3 wherein each said conveyor drive is controllable independently of other conveyor drives.

5. The transport wagon of claim 1 where said angle is about 25°.

6. The transport wagon of claim 1 further comprising a control device and a lateral tilt measuring device connected to pivot drives of said control flaps for automatic control of said control flaps in dependence on superelevation.

7. The transport wagon of claim 1 wherein said lower edge of said control flap is displaceable towards said conveyor belt.

8. The transport wagon of claim 1 wherein said sidewalls project over the front end of said conveyor belt and each of said control flaps is secured to a lower end of a projecting section of said sidewalls.

9. An installation for transporting and unloading bulk material comprising a plurality of transport wagons according to claim 1, said transport wagons being disposed one behind another in the longitudinal direction of said wagons, each of said wagons having said individual conveyor belts and being coupled together to form a train formation, and further comprising a drive wagon movable on on-track undercarriages and having coupling devices and a central power plant, said drive wagon being located between successive transport wagons, said drive wagon having a conveyor belt arrangement with a lower-lying receiving end and an elevated discharge end and extending in a longitudinal direction of said drive wagon.

10. The installation of claim 9 further comprising a discharge wagon movable on on-track undercarriages and located near a front region of said installation relative to a transport direction, said discharge wagon including a conveyor belt arrangement extending in a longitudinal direction of said discharge wagon, said conveyor belt arrangement of said discharge wagon including a ballast store with outlet openings between a rear receiving end and a front discharge end.

11. The installation of claim 10 further comprising a discharge conveyor belt associated with each of said outlet opening of said ballast store, said discharge conveyor belt being pivotable about a vertical axis and comprising a pivot and conveyor belt drive.

* * * * *